US005659223A

United States Patent [19]

Goodman

[11] Patent Number: 5,659,223

[45] Date of Patent: Aug. 19, 1997

[54] SYSTEM FOR EXTRACTING A HIGH POWER BEAM COMPRISING AIR DYNAMIC AND FOIL WINDOWS

[75] Inventor: Daniel Goodman, Brookline, Mass.

[73] Assignee: Science Research Laboratory, Inc., Somerville, Mass.

[21] Appl. No.: 502,685

[22] Filed: Jul. 14, 1995

[51] Int. Cl.[6] ..... H01J 33/04

[52] U.S. Cl. ..... 315/39; 313/420; 250/492.3

[58] Field of Search ..... 250/492.3, 505.1; 315/39; 313/420; 372/2, 74, 104

[56] References Cited

U.S. PATENT DOCUMENTS

| | | | |
|---|---|---|---|
| 2,574,655 | 11/1951 | Panofsky et al. | 313/420 X |
| 2,820,165 | 1/1958 | Robinson | 313/420 X |
| 3,105,916 | 10/1963 | Marker et al. | 313/420 X |
| 3,287,735 | 11/1966 | Day, Jr. | 313/420 X |
| 3,607,680 | 9/1971 | Uno et al. | 313/420 X |
| 4,121,128 | 10/1978 | Roberts | 313/7 |
| 4,362,965 | 12/1982 | Kendall | 313/420 |
| 5,173,142 | 12/1992 | Billiu | 156/245 |
| 5,235,239 | 8/1993 | Jacob et al. | 313/363.1 |

OTHER PUBLICATIONS

W. Panofsky et al., "A Focusing Device for the External 350–Mev Proton Beam of the 184–Inch Cyclotron at Berkeley", May/1950, pp.445–447 View of Scientific Instruments, vol. 21, No. 5.

B.J. Hughey, R.E. Shefer, R.E. Klinkowstein and J.J. Welch, "Design Considerations for Foil Windows for PET Radioisotope Targets," Proc. Fourth Int. Workshop on Targetry and Targetry Chemistry, R. Weinreich, ed., PSI Villigen, Switz, (1991).

A. Brent Strong et al. "Crosslinking of Thermoplastic Composites Using Electron Beam Radiation", 1991, pp.45–54, Sampe Quarterly.

Chris B. Saunders et al. "Electron Curing of Fiber–Reinforced Composites: Recent Developments", 1993, 1681–1685, Sampe Quarterly.

*Primary Examiner*—Benny Lee
*Assistant Examiner*—Justin P. Bettendorf
*Attorney, Agent, or Firm*—Wolf, Greenfield & Sacks, P.C.

[57] ABSTRACT

A system for extracting a high power beam from a vacuum in which a beam is generated into atmosphere, which system is formed of: (a) a thin foil window of a material having good heat dissipation properties positioned adjacent the vacuum to permit the beam to pass therethrough; and (b) an air dynamic window between the foil window and the atmosphere. The foil window and air dynamic window are designed such that most of the pressure ratio drop from vacuum to atmosphere is across the foil window and most of the pressure drop in psi is across the air dynamic window.

20 Claims, 2 Drawing Sheets

SYSTEM FOR EXTRACTING A HIGH POWER BEAM COMPRISING AIR DYNAMIC AND FOIL WINDOWS

FIELD OF THE INVENTION

This invention relates to systems for the production of high power particle beams and more particularly to a system for facilitating the extraction to atmosphere of such high power beams from a vacuum in which they are generated.

BACKGROUND OF THE INVENTION

High power electron, ion and other particle beams are used in a variety of medical, scientific, and industrial applications including, for example, the use of electron beams to cure various polymers and other composites. One problem which has hindered the further application of such high power beams is the difficulty of extracting the beam from the vacuum environment in which they are normally generated to atmosphere where the beams are used for most applications.

Heretofore, two techniques have typically been used for accomplishing such beam extraction, each of which has severe limitations. The first technique uses a thin foil window, with titanium being a typical material used for such windows. While such windows are compact and do not pose limitations on the diameter of the beam being extracted, the high pressure differential across these windows, which is roughly 14 psi, requires a thickness of window and the use of material having sufficient strength, and in particular sufficient burst strength or ultimate tensile strength at high temperature, so as to be able to function at such a pressure differential without bursting. However, the thickness of such foils and the materials such as titanium which are required to achieve an ultimate tensile strength sufficient to support a 14 psi pressure differential results in significant heating of the window during high power extraction as the window absorbs energy from the beam. This heating can lead to catastrophic implosion. Attempts have been made to control the heating of the foil by providing water cooling around the periphery. However, the foils remain difficult to cool and this has meant that the amount of beam power per unit area which can be transmitted through the foil window is limited. This is a particular problem when dealing with low energy beams (i.e. less than 500 keV) because low energy beams deposit a higher fraction of their power on the foil windows than do higher energy beams. However, low energy beams are desirable for many application. Further, the problem of window heating significantly shortens the useable life of a window, resulting in the need for more frequent window replacement, either because of window failure, or preferably through routine maintenance. Since the system cannot be used during window replacement, and since window replacement is a relatively difficult and time consuming procedure because of the large pressure differentials across the window, the need for frequent window replacements signficantly increases the cost of operating the beam generating equipment and signficantly reduces the efficiency with which such equipment can be used.

The second technique is referred to as differential pressure extraction or more generally as air dynamic window extraction. These techniques involve passing the beam through successive differentially pumped chambers to maintain the desired vacuum in the beam generation chamber. The advantage of these techniques is that they place no limit on the amount of power which can be extracted. However, each pumping stage takes up a significant space, particularly in the direction of the beam, and the number of pumping stages required to get from vacuum to atmospheric pressure can be substantial, resulting in a relatively long and cumbersome device which can also be relatively expensive to operate. However, the most significant limitation on the systems is that, since the pumping rate is proportional to aperture diameter, the systems as a practical matter are limited to relatively small diameter beams (approximately 2 mm or less).

A need therefore exists for an improved extraction system for use with high power beams in general, and with high power, low energy electron beams in particular, which does not impose significant limitations on either the power of the beam being extracted or on the diameter of the extracted beam, while not being unduly cumbersome or expensive to operate. Such a system should also not impose an undue maintenance burden.

SUMMARY OF THE INVENTION

In accordance with the above, this invention provides an extraction system for a high power beam from a vacuum in which the beam is generated into the atmosphere, which system is formed of: (a) a thin foil window of a material having good heat dissipation properties positioned adjacent the vacuum to permit the beam to pass therethrough; and (b) an air dynamic window between the foil window and the atmosphere. The foil window and the air dynamic window are designed such that the transition from high vacuum to rough vacuum (i.e. most of the pressure ratio drop) is across the foil window while most of the pressure drop in psi is across the air dynamic window. In particular, for preferred embodiments, the pressure ratio drop in Torr across the foil window is approximately eight to nine orders of magnitude, with the pressure ratio drop in Torr across the air dynamic window being approximately one to two orders of magnitude. In psi, the drop across the foil window is approximately 0.1 to 1.5 psi while the pressure drop across the air dynamic window is approximately 13.2 to 14.6 psi.

The air dynamic window preferably includes at least two differentially pumped stages. Where there are two differentially pumped stages, the pressure drop in Tort for the stage closer to the atmosphere is greater for a preferred embodiment than for the other stage. Where there are more than two stages, the vacuum pumps for two of the stages are preferably larger than the pumps for the remaining stages. The foil window may be formed of a material which oxidizes in the presence of oxygen, for example a graphite material. When such a foil window material is used, an inert gas is introduced into the beam path between the foil window and the air dynamic window to prevent air from reaching the window and thus to prevent oxidation thereof.

The foil window is preferably formed of a material which has high ultimate tensile strength, even at elevated temperatures, and which also preferably has high radiative emissivity. For preferred embodiment, this material is a graphite, and more particularly an amorphous carbon foil. The thickness of the foil may be approximately 1 to 30 micrometers. In order to minimize leakage through the foil, a double foil window may be utilized with each foil being roughly half the total thickness of the window.

A valve may also be provided which, when opened, permits beam extraction and which, when closed, prevents loss of vacuum in the absence of the foil window. An element may also be provided for releasably forming a seal with the foil window in a position adjacent the vacuum and a carrier may be provided for bringing a replacement foil window into the desired position to replace the foil window in such position, the seal for the previously used foil being released prior to replacement and the replacement foil window being sealed in place when it is in the desired position. This mechanism facilitates window replacement when such replacement is required, thereby minimizing the down-time required for such operation and increasing the efficiency at which the system is operated.

Finally, a pump stage, for example a plasma arc pump, may be provided between the foil window and atmosphere to reduce the quantity of air entering the dynamic window. Alternatively, in proper application, pump stages used between the foil window and atmosphere might be a dynamic window or some type of pump other than or in addition to a dynamic window.

The foregoing and other objects, features and advantages of the invention will be apparent from the following more particular description of preferred embodiments of the invention as illustrated in the accompanying drawings.

IN THE DRAWINGS

DETAILED DESCRIPTION

Various systems for generating high energy electrons, ion or other particle beams, require that such beams be generated in a vacuum environment. Such a high power beam might for example have 250 kW and might also have a high energy in the one to ten MeV range. However, such high power beams are also generated at lower energies, for example, energies in a 500 keV range and below. Examples of systems for generating high power particle beams are taught for example in U.S. Pat. Nos. Re 34,575 and in 5,135,704. As discussed above, one problem with such high power systems has been extracting the beam from the vacuum chamber in which the beam is formed.

Figure 1:
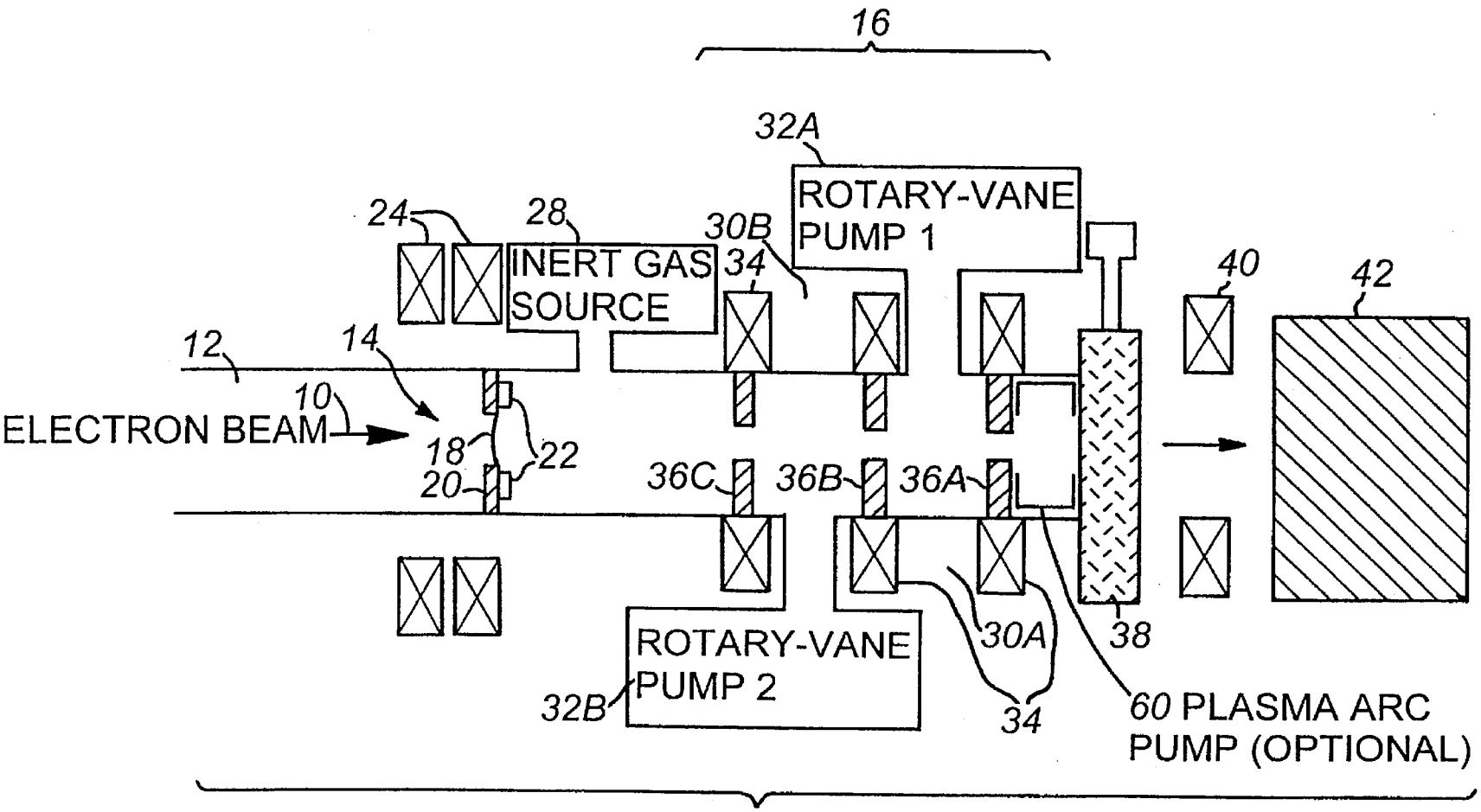
FIG. 1 is a diagrammatic cutaway side view of a beam extraction system in accordance with a preferred embodiment of the invention.

Referring to FIG. 1, a window for performing such beam extraction is shown. In this figure, an electron or other energy beam 10 is generated in a vacuum chamber 12, with only the portion of this chamber adjacent to window beam shown. The window is in two parts, a foil window portion 14 and an air dynamic window or differentially pumped portion 16. Foil window portion 14 includes a thin foil window 18, a holder for the window 20, and clamping elements 22 for holding the foil in place. Holder 20 may be cooled by running water therethrough or by other suitable means, but for reasons to be discussed later, such cooling is generally not necessary when utilizing the teachings of this invention. A pair of beam transport magnets 24 are also provided for this stage.

Figure 2:
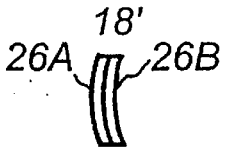
FIG. 2 is a side view of a foil window for an alternative embodiment of the invention.

Foil 18 is very thin, having a thickness of approximately 1 to 30 micrometers, and is preferably formed of a material which has high burst strength/ultimate tensile strength at elevated temperatures and which has high radiative emissivity. For a preferred embodiment the foil is formed of a graphite material, and in particular of an amorphous carbon foil. While the foil window 18 may be formed of a single layer of foil, minor imperfections in such a thin foil can permit some leakage through the foil. To minimize leakage, a foil 18' such as that shown in FIG. 2, may be utilized, which foil is formed of two layers 26A, 26B of graphite foil mounted adjacent each other, the combined thickness of the two layers being equal to the thickness previously indicated. Leakage is reduced or eliminated by the fact that imperfections in the foil layers 26 are unlikely to be aligned.

Since the graphite/amorphous carbon material utilized for foil 18 is subject to oxidation, it is desirable to prevent air from coming in contact with the foil. Therefore, an inert gas source 28 positioned between windows 14 and 16 provides an inert gas purge, for example an argon purge, adjacent to foil window 18 which blocks air from reaching the window.

For the embodiment shown in FIG. 1 the air dynamic window 16 is shown as being formed from two differentially pumped stages 30A and 30B. Each stage includes a pump 32A and 32B, respectively, for removing air from the stage, and beam transport magnets 34 for controlling the beam as it passes through the stage. Differential pumping apertures 36A–36C are also provided for the stages.

At the far end of air dynamic window 16 is a gate valve 38 which may be closed to seal the window. After passing through windows 14 and 16, the beam passes through and is controlled by steering and focusing magnets 40 before impinging on a suitable target 42. The nature of target 42 will depend on application.

Since the greater the pressure differential (i.e. the greater the ratio between the pressures) at the outputs from adjacent stages 30, the smaller the area of the beam for a constant pumping speed by the pumps 32, (i.e. $p1/p2=kS/A$; where p1 is a pressure at the input to stage 1, p2 is the pressure at the input to stage 2, k is a constant, S is the pumping speed, and A is the area of the beam), it is desirable to keep the pressure differential between adjacent stages of the differentially pumped window as small as possible. However, since the pressure differential between the vacuum in chamber 12 and atmosphere where target 42 is located is typically approximately ten orders of magnitude, in order to achieve a reasonable beam diameter, it may be necessary to use ten or more differentially pumped stages in order to achieve a beam diameter of acceptable size. The alternative is to use a beam having a very small cross sectional area which is not suitable for many applications, and even such a small beam may require five or more stages. Such multi-stage differentially pumped windows are therefore quite long along the beam line and therefore bulky and sometimes awkward to use. They are also relatively expensive because of the number of powerful pumps required and the operation of that many pumps also makes operation of such windows expensive. It is therefore desirable to minimize the ratio of the drop across the air dynamic window 16 so that this drop can be handled by as few differentially pumped stages as possible, thereby permitting the use of a larger area beam and also limiting both the bulk and cost of the overall system.

By contrast, the burst strength of window 18 is determined by the absolute difference in pressure across the window rather than ratio of pressures. Therefore, while the ratio in pressure from the vacuum in chamber 12 to a value of, for example, 1.5 psi, represents approximately eight orders of magnitude in pressure change, and would therefore require eight or more differentially pumped stages in order to achieve a beam area of reasonable size, the forces on foil window 18 are only 1.5 psi, approximately 10% of full atmospheric pressure. This relatively small pressure permits a much thinner foil to be utilized than that needed to support full atmospheric pressure and permits a foil to be utilized which has a lower burst or ultimate tensile strength. The thinner foil absorbs less energy from the beam and therefore generates less heat. Further, by using a material with high radiative emissivity such as an amorphous carbon or certain other graphites, the entire foil can be cooled by radiative emission which is more efficient than cooling only the edges of the foil by means of water flowing through the housing. Higher power beams can thus be passed by the window without excess heating of and potential damage to the foil.

Conversely, since the differentially pumped stages 30 do not contain an element which can burst as a result of pressure drop thereacross, these stages can handle the 12 to 14 psi drop which might occur across these stages without difficulty. Thus, by designing the system such that most of the transition from high vacuum to rough vacuum (i.e. most of the pressure ratio drop) is across the foil window portion 14, while most of the pressure drop in psi occurs across the air dynamic window 16, advantage is taken of the strengths of each type of window so as to permit optimum beam energy and power with optimum beam radius. For a preferred embodiment, there is approximately a 1.4 psi drop across the foil window 18. The pressure drop across aperture 36A is approximately 490 Torr (9.5 psi) and the drop across the aperture 36B is approximately 200 Torr (3.9 psi). If a wider beam is desired than that provided by the preferred embodiment, additional pumping stages 30 may be employed so as to further reduce the pressure differential in Torr across each differentially pumped stage. When this is done, the pump 32 used for two of the stages would typically be larger than those used for the remaining stages. If a narrower beam is desired than provided by the preferred embodiment, narrower apertures 36 will reduce the pressure at foil window portion 14. This will allow a thinner foil 18 to be used, which is advantageous for very high power operation.

Figure 3:
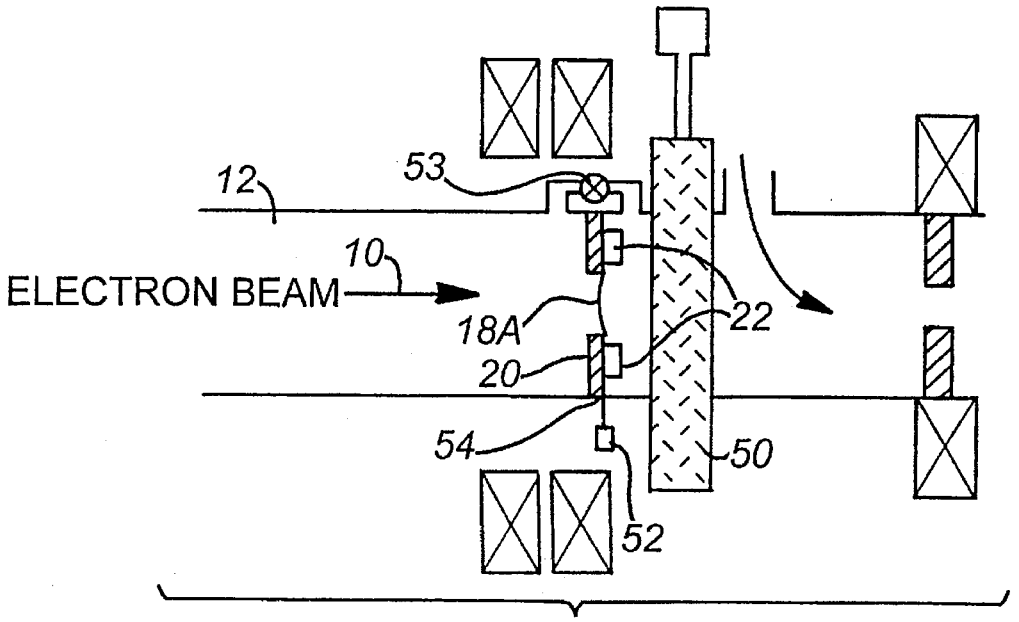
FIG. 3 is a diagrammatic cutaway side view of a portion of the system shown in FIG. 1 as modified to facilitate replacement of the foil window.
Figure 4:
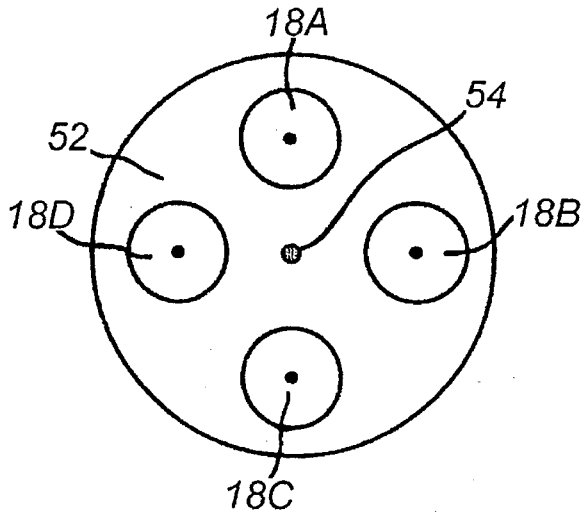
FIG. 4 is a front view of a carousel containing four foil windows suitable for use with the embodiment shown in FIG. 3.

FIGS. 3 and 4 illustrate an alternative embodiment of the invention which differs than that shown in FIG. 1 in three respects. First, a gate valve 50 is added between the film window and the air dynamic window, and in particular as close to the film window as possible. The purpose of the gate valve 50 is to permit vacuum to be maintained in chamber 12 in the absence of foil window 18. A second difference is that window 18 is a window 18A which is one of four windows mounted on a carousel 52 which is rotatable about an axis 54. A third difference is the addition of a bypass valve 53 across foil window 18A. During an initial evacuation of region 12, bypass valve 53 is open to equalize pressure across the foil. More particularly, during initial installation of foil 18, bypass value 53 is open and gate valve 50 (and/or 38) is closed until the acceleration area 12 reaches high vacuum ($10^{-7}$ Torr). The bypass valve is closed during normal machine operation.

In operation, when a window 18 is to be replaced, gate valve 50, and probably also gate valve 38, are closed to seal the window. Particularly if gate valve 38 is also closed, pumps 32 and 28 may be turned off. Clamps 22 are then loosened and carousel 52 rotated, either by hand or by a suitable motor or other mechanism, to bring a replacement window, for example window 18B, into the operative window position. Clamps 22 are then operated to reseal the new foil window 18B in place. The gate valves may then be opened and pumps restarted to restore normal operation. This procedure permits the rapid replacement of a number of windows contained on carousel 52. While for purposes of illustration four such windows have been shown in FIG. 4, this is by way of illustration only and a larger number of windows may be provided on the carousel in a selected application. This significantly reduces the system down time required for periodic replacement of the foil windows.

While the invention has been particularly shown and described above with reference to preferred embodiments, it will be apparent to those skilled in the art that the various modifications in the embodiments shown which have been discussed previously, as well as other variations, may be made without departing from the spirit scope of the invention. For example, an atmospheric plasma arc acting as a pump 60 could be added, as shown, on the atmospheric (right) side of gate valve 38. A suitable pump would be similar to pumps known in the art, modified with a larger diameter aperture. Such a pump, which operates by ionizing air molecules and utilizing a magnetic field to sweep away the ionized molecules, would reduce the required power rating of pumps 32A and 32B by reducing the quantity of air entering differential pumping section 16. Such an embodiment would be best suited for higher energy (E>1 MeV) electron or other beam systems, since the plasma arc would disturb the trajectory of lower energy electrons and other beam particles. With beams of high enough energy and/or with beams of a type whose trajectory would not be significantly affected by the plasma arc, plasma arc pumps could be used instead of one or both of the differentially pumped stages. Other pump stages which are capable of removing significant quantities of air molecules might also be used either as an extra stage in lieu of the plasma arc pump or in lieu of the differentially pumped stages. The invention is therefore only to be limited by the following claims:

What is claimed is:

1. A system for extracting a high power beam from a vacuum in which the beam is generated into the atmosphere comprising:

a thin foil window of a material having good heat dissipation properties positioned adjacent the vacuum to permit the beam to pass therethrough; and an air dynamic window between the foil window and the atmosphere;

most of the pressure ratio drop from vacuum to atmosphere being across the foil window, and most of the pressure drop in psi being across the air dynamic window.

2. A system as claimed in claim 1 wherein the pressure ratio drop in Torr across the foil window is approximately eight to nine orders of magnitude and the pressure ratio drop in Torr across the air dynamic window is approximately one to two orders of magnitude.

3. A system as claimed in claim 1 wherein the pressure drop in psi across the foil window is approximately 0.1 to 1.5 psi and the pressure drop in psi across the air dynamic window is approximately 13.2 to 14.6 psi.

4. A system as claimed in claim 1 wherein the air dynamic window includes at least two differentially pumped stages.

5. A system as claimed in claim 4 wherein there are two differentially pumped stages.

6. A system as claimed in claim 5 wherein the pressure drop in Torr for the stage closer to atmosphere is greater than for the other stage.

7. A system as claimed in claim 4 wherein there are more than two stages, wherein there is a vacuum pump for each stage, and wherein the pumps for two of said stages are larger than the pumps for the remaining stages.

8. A system as claimed in claim 1 wherein the foil window is formed of a material which oxidizes in the presence of air, and including an inert gas purge introduced into the beam path between the foil window and the air dynamic window.

9. A system as claimed in claim 1 wherein the foil window is formed of a material which has high ultimate tensile strength even at elevated temperatures.

10. A system as claimed in claim 9 wherein the material for the foil window has high radiative emissivity.

11. A system as claimed in claim 10 wherein the material for the foil window is a graphite.

12. A system as claimed in claim 11 wherein the material for the foil window is an amorphous carbon foil.

13. A system as claimed in claim 10 wherein the foil has a thickness of approximately 1 to 30 μm.

14. A system as claimed in claim 13 wherein the foil window is a double-foil window, with each foil being roughly half the total thickness of the window.

15. A system as claimed in claim 1 including a valve which, when open, permits beam extraction and which, when closed, prevents loss of vacuum in the absence of said foil window, an element for releasably forming a seal with the foil window in the position adjacent the vacuum, and a carrier for bringing a replacement foil window to said position to replace the foil window previously in said position, the element releasing the seal for the previously used foil window prior to replacement and sealing the replacement foil window when it is in said position.

16. A system as claimed in claim 1 wherein said high power beam is an electron beam.

17. A system as claimed in claim 1 including a bypass valve across the foil window to allow selective equalization of pressures thereacross.

18. A system as claimed in claim 1, including a pump stage between the air dynamic window and atmosphere to reduce the quantity of air entering the air dynamic window.

19. A system as claimed in claim 18 wherein said pump stage is a plasma arc.

20. A system for extracting a high power beam from a vacuum in which the beam is generated into the atmosphere comprising:

a thin foil window of a material having good heat dissipation properties positioned adjacent the vacuum to permit the beam to pass therethrough; and at least one pump stage between the foil window and atmosphere for effecting the removal of air molecules;

most of the pressure ratio drop from vacuum to atmosphere being across the foil window, and most of the pressure drop in psi being across the at least one pump stage.

* * * * *